US012680794B2

(12) United States Patent
Moore-Montgomery

(10) Patent No.: US 12,680,794 B2
(45) Date of Patent: Jul. 14, 2026

(54) BULLET CATCHER TARGET APPARATUS

(71) Applicant: Brandon Moore-Montgomery, Reno, NV (US)

(72) Inventor: Brandon Moore-Montgomery, Reno, NV (US)

( * ) Notice: Subject to any disclaimer, the term of this patent is extended or adjusted under 35 U.S.C. 154(b) by 410 days.

(21) Appl. No.: 18/234,430

(22) Filed: Aug. 16, 2023

(65) Prior Publication Data

US 2024/0110770 A1 Apr. 4, 2024

Related U.S. Application Data

(60) Provisional application No. 63/412,222, filed on Sep. 30, 2022.

(51) Int. Cl.
*F41J 13/02* (2009.01)
*F41J 1/10* (2006.01)
*F41J 7/00* (2006.01)

(52) U.S. Cl.
CPC ..... *F41J 13/02* (2013.01); *F41J 1/10* (2013.01); *F41J 7/00* (2013.01)

(58) Field of Classification Search
CPC ..... F41J 13/02; F41J 1/10; F41J 7/00
See application file for complete search history.

(56) References Cited

U.S. PATENT DOCUMENTS 2,013,133 A * 9/1935 Caswell ..... F41J 13/00 273/410
2,899,204 A * 8/1959 Ratay ..... F41J 1/10 D21/699
4,126,311 A * 11/1978 Wagoner ..... F41J 13/00 273/410
5,715,739 A * 2/1998 White ..... F41J 13/02 273/404
6,530,572 B1 * 3/2003 Overley ..... F41J 13/00 273/410
10,030,945 B1 * 7/2018 Mol ..... F41J 13/00
2013/0187336 A1 * 7/2013 Dreiband ..... F41J 13/02 273/410
2016/0003584 A1 * 1/2016 Durynski ..... F41J 13/02 273/410

FOREIGN PATENT DOCUMENTS

CH 702539 A2 * 7/2011 ..... F41J 13/02

* cited by examiner

*Primary Examiner* — Jeffrey D Carlson

(74) *Attorney, Agent, or Firm* — Mark A. Goodman; Goodman Law Center

(57) ABSTRACT

A bullet catcher target apparatus is compact and portable with a target enclosure and telescoping legs that can be set up to meet any terrain (e.g., gravel, sand, dirt, asphalt, flat, sloped, humps or high spots, etc.). The bullet catcher target apparatus uses a tripod style base leg socket, fixed to the target enclosure. The legs each include outer legs that slide inside the leg sockets, and inner legs that slide into the outer legs. The telescoping legs have tension handles for tightening and adjusting a height of the legs to meet desired user heights, shooting angles and positions. Storage sockets are fixed to the target enclosure for leg storage, making the bullet catcher target apparatus compact when being transported location to location and/or for manageable storage.

7 Claims, 12 Drawing Sheets

BULLET CATCHER TARGET APPARATUS

CROSS REFERENCE

This patent application claims the benefit of provisional patent application 63/412,222 entitled BULLET CATCHING SYSTEM AND METHOD filed on Sep. 30, 2022. The above patent application is hereby incorporated by reference in this patent application.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of projectile targets of existing art and more specifically relates to a bullet catcher target apparatus.

RELATED ART

Practicing shooting is a crucial aspect of improving one's marksmanship skills, whether for sport or self-defense. To become proficient in shooting, an individual must dedicate time and effort to training and practicing regularly. There are various tools and methods used to practice shooting. For example, target apparatus are known in the art to provide a clear and visible target for shooters to aim at. Common types of targets include paper targets or steel targets which can be used in shooting ranges or outdoors. However, there are disadvantages to current targets on the market. For example, steel targets can pose a ricochet hazard, having the potential to cause harm to people and items therearound. Further, many current targets do not provide enough visual feedback or variety.

Further, shooting practice is often a costly experience as ammunition prices can be high. It's not uncommon for an individual to shoot between 200-400 bullets during a training session, which can quickly add up in expenses. As such, bullet traps have been developed for stopping and containing bullets safely for later collection and recycling. However, current bullet traps are not satisfactory. For example, many current bullet traps are often bulky and heavy, and as such are not easily portable. In addition, many current bullet traps also have the potential for ricochets or fragments to escape the trap, which can be hazardous to people or property. Thus, a suitable solution is desired.

SUMMARY OF THE INVENTION

In view of the foregoing disadvantages inherent in the known bullet catcher art, the present disclosure provides a novel bullet catcher target apparatus. The general purpose of the present disclosure, which will be described subsequently in greater detail, is to provide an apparatus with a target, a bullet catcher toward a rear of the target and legs attached to the target that enables the apparatus to be able to move into various shooting positions, as well as various storage and transportation positions.

A bullet catcher target apparatus is disclosed herein. In some embodiments, the bullet catcher target apparatus may comprise a target enclosure, a bullet catcher, at least three legs and at least one handle. The target enclosure may include a front opposite a rear, a bottom plate opposite a top plate and two opposing side plates. Preferably, the plates may be angled such that the target enclosure tapers toward a rear thereof, thereby causing a bullet shot through the front target wall to be funneled to the rear of the target enclosure. The bullet catcher may be attached at the rear of the target enclosure and configured to receive the bullet, stop momentum of the bullet, and hold the bullet therein. The at least three legs may be attached about the target enclosure and may be independently height adjustable and movable between at least a prone position, a kneeling position and one or more standing positions. The at least one handle may be attached about the target enclosure and facilitate portability of the bullet catcher target apparatus.

According to another embodiment, the bullet catcher target apparatus may comprise a target enclosure, an elongated cylindrical tube, at least three telescopic legs and a pair of handles. The target enclosure may include a detachable front target wall, a bottom plate, a top plate and two side plates. The plates may be angled relative to the front target wall such that the target enclosure tapers toward a rear thereof, thereby causing a bullet shot through the front target wall to be funneled to the rear of the target enclosure. The elongated cylindrical tube may be attached at the rear of the target enclosure behind the front target wall and may include a top cap, a bottom cap, an opening through which the bullet is funneled, and an elongated bullet stop configured to stop momentum of the bullet as it travels around a curvature of the elongated cylindrical tube. The elongated cylindrical tube may be configured to hold the bullet therein and the bottom cap may be movable to enable removal of the bullet from the elongated cylindrical tube.

The at least three telescopic legs may be removably attached to the enclosure and may include an inner leg and an outer leg enabling the at least three telescopic legs to be independently height adjustable and movable between at least a prone position, a kneeling position and one or more standing positions. The pair of handles may be attached about the enclosure and may facilitate portability of the bullet catcher target apparatus.

According to another embodiment, the bullet catcher target apparatus may comprise a target enclosure, an elongated cylindrical tube, at least three telescopic legs, at least three leg sockets, at least three storage sockets, a pair of handles and a transportation wheel assembly. The target enclosure may include a detachable front target wall made from a self-healing ballistic rubber; a bottom plate; a top plate; and two side plates; the plates being angled relative to the front target wall such that the target enclosure tapers toward a rear thereof, thereby causing a bullet shot through the front target wall to be funneled to the rear of the target enclosure. The elongated cylindrical tube may be attached at the rear of the target enclosure behind the front target wall and may include a top cap, a bottom cap, an opening through which the bullet is funneled, and an elongated bullet stop configured to stop momentum of the bullet as it travels around a curvature of the elongated cylindrical tube. The elongated cylindrical tube may be configured to hold the bullet therein and the bottom cap may be movable to enable removal of the bullet from the elongated cylindrical tube.

The at least three telescopic legs may be removably attached about the target enclosure and may include an inner leg and an outer leg such that the at least three legs are independently height adjustable and movable between at least a prone position, a kneeling position and one or more standing positions. The at least three leg sockets may be attached toward a bottom end of the bullet catcher and configured for insertion into one of the at least three leg sockets. The at least three leg sockets may be configured to hold the at least three legs in the kneeling position and the one or more standing positions.

A portion of the at least three storage sockets may be attached about a mid-point of the bullet catcher and another portion of the at least three storage sockets may be attached to one of the plates. The at least three legs may each be configured for insertion into one of the at least three storage sockets and the at least three storage sockets may be configured to hold the at least three legs in the prone position, a storage position and a transportation position. The pair of handles may be attached about the target enclosure, and the transportation wheel assembly may be configured for removable attachment about the target enclosure; both facilitating portability and transportation of the bullet catcher target apparatus.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments of the present disclosure, a bullet catcher target apparatus, constructed and operative according to the teachings of the present disclosure.

The various embodiments of the present invention will hereinafter be described in conjunction with the appended drawings, wherein like designations denote like elements.

DETAILED DESCRIPTION

Figure 1:
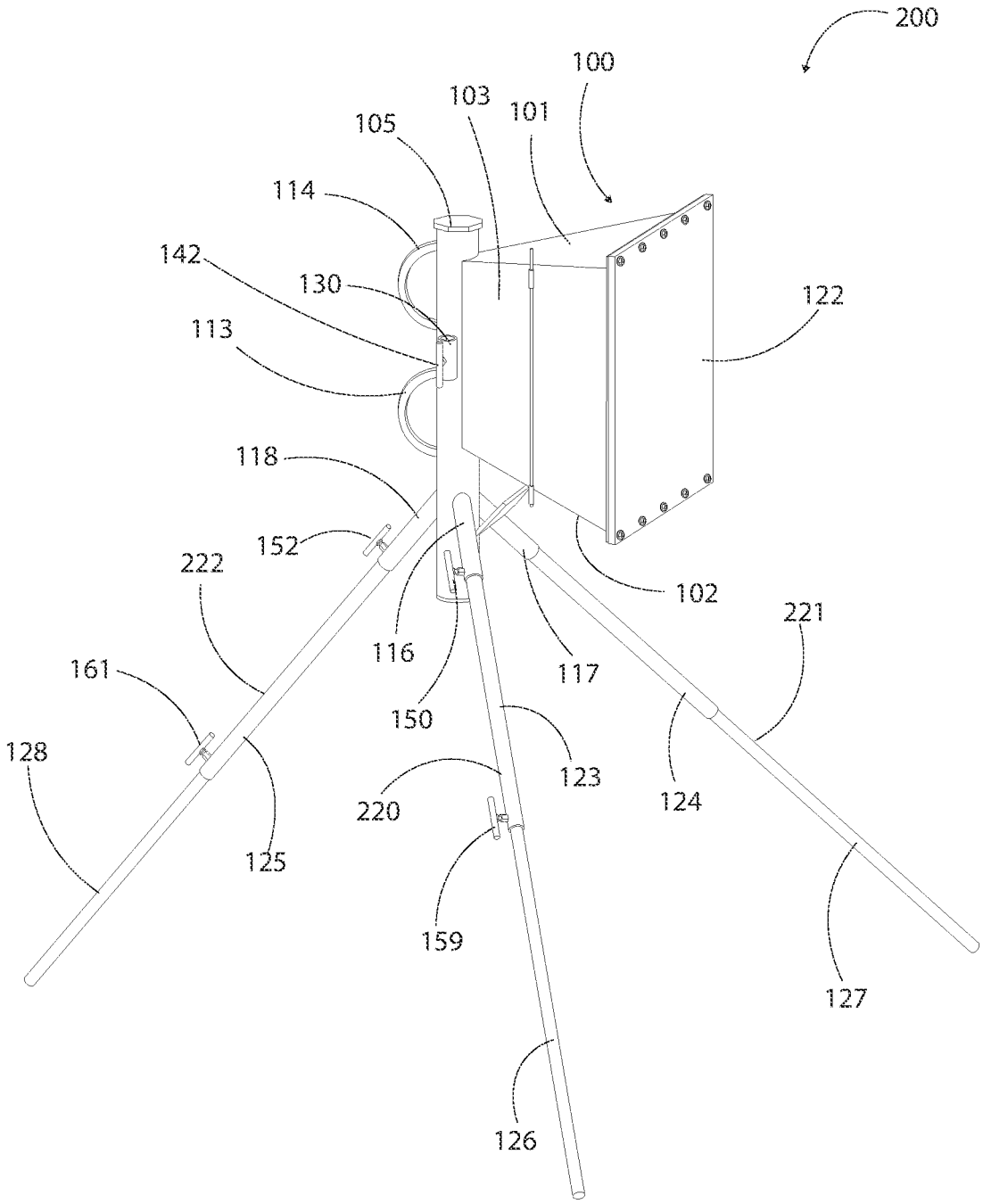
FIG. 1 is a left side perspective view of the bullet catcher target apparatus including a target enclosure, a bullet catcher, three telescopic legs and a pair of handles, according to an embodiment of the disclosure.

Reference will now be made in detail to exemplary embodiments and methods of using the present invention, bullet catcher target apparatus. It should be noted that the invention is not necessarily limited to the specific details, representative materials and methods, and illustrative examples shown and described in the present disclosure and accompanying figures in connection with the exemplary embodiments and methods.

Reference numerals. To aid in the understanding of the present invention, the reference numerals correspond to respective elements of the invention as follows.

200—bullet catcher target apparatus
100—target enclosure
101—top plate
102—bottom plate
103—left side plate
104—right side plate
105—collector tube
106—leg deflection shield
107—top cap
108—bottom cap
109—bottom cap bolt
110—bottom cap wingnut
111—top tab
112—bottom tab
113—inner backstop
114—first moving handle
115—second moving handle
116—left side leg socket
117—right side leg socket
118—rear side leg
119—left side leg socket gusset
120—right side leg socket gusset
121—rear leg socket gusset
122—ballistic ricochet rubber
123—left side outer leg
124—right side outer leg
125—rear outer leg
126—left side inner leg
127—right side inner leg

128—rear inner leg
129—plate storage socket
130—left side storage socket
131—right side storage socket
132—tabs bolts
133—tabs nuts
134—tabs washers
135—plate storage socket nut
136—elongated tube left storage socket nut
137—elongated tube right storage socket nut
138—plate storage socket bolt
139—elongated tube left storage socket bolt
140—elongated tube right storage socket bolt
141—plate storage socket handle rod
142—elongated tube left storage socket handle rod
143—elongated tube right storage socket handle rod
144—left side leg socket nut
145—right side leg socket nut
146—rear leg socket nut
147—left side leg socket bolt
148—right side leg socket bolt
149—rear leg socket bolt
150—left side leg socket handle rod
151—right side leg socket handle rod
152—rear leg socket handle rod
153—left outer leg nut
154—right outer leg nut
155—rear outer leg nut
156—left outer leg bolt
157—right outer leg bolt
158—rear outer leg bolt
159—left outer leg handle rod
160—right outer leg handle rod
161—rear outer leg handle rod
162—a cleaning rod
163—first sleeve
164—second sleeve
165—a hitch pin
166—stationary wheel assembly
167—a flat bar
168—welded leg
169—an insert socket
170—insertable pipe
171—a flat tab
172—a tension handle
173—transportation wheel Referring now more specifically to the drawings by numerals of reference, there is shown in FIGS. 1-12, various views of a bullet catcher target apparatus 200. As shown in these figures, the bullet catcher target apparatus 200 may comprise a target enclosure 100, a collector tub 105, at least three legs 220, 221, 222 and at least one handle 114, 115.

Figure 2:
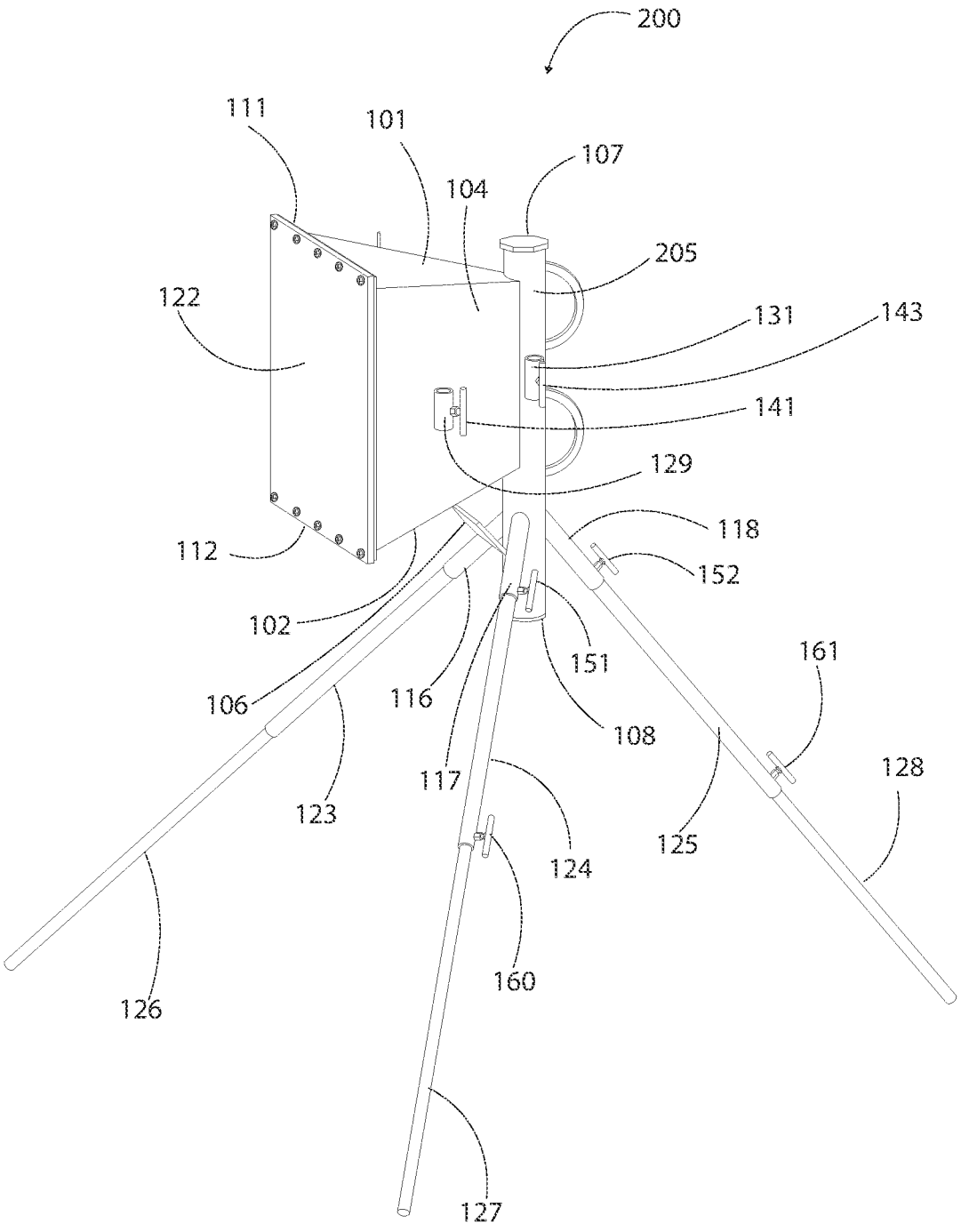
FIG. 2 is a right side perspective side view of the bullet catcher target apparatus, according to an embodiment of the disclosure.

Referring particularly to FIGS. 1-2, as shown here, the at least one handle 114, 115 may be attached about the target enclosure 100 and aids in portability of the bullet catcher target apparatus 200. Particularly, the at least one handle 114, 115 may include a pair of handles 114, 115 attached to an exterior of the target enclosure 100. In some examples, the handles 114, 115 may include an arcuate or semi-circular configuration. Further, in some embodiments the handles 114, 115 may be detachable. It should also be appreciated that the bullet catcher target apparatus 200 is not limited to two handles.

Further, as shown, the target enclosure 100 may be a four-sided target enclosure 100. Particularly, the target enclosure 100 may include a front target wall 122, a bottom plate 102, a top plate 101 and two side plates 103, 104. In some embodiments, the front target wall 122 may be made of, or otherwise include, rubber, or more specifically, self-healing rubber that covers an entire front of the target enclosure 100 and acts as a ricochet and back spatter protector, substantially slowing down a bullet shot at the front target wall 122. It should however be appreciated that the front target wall 122 is not limited to rubber. It should also be appreciated that the front target wall 122 may not be limited to this configuration.

Preferably, the front target wall 122 may be detachable from the target enclosure 100, enabling the front target wall 122 to be replaced; for example, when the rubber or other material on the front target wall 122 becomes worn and ready to be changed. A top of the front target wall 122 may be attached to a top of the top plate 101 and a bottom of the front target wall 122 may be attached to a bottom of the bottom plate 102. Particularly, top and bottom tabs 111, 112 may be attached to the top and bottom plate 101, 102 respectively; and washers, nuts and bolts may be used to attach the front target wall 122 to the top and bottom tabs 111, 112. Further, the top and bottom tabs 111, 112 may be used for attaching a wide range of targets (e.g., paper targets) thereon. Further, in some embodiments, the target enclosure 100 may include target tab deflectors (not illustrated) to protect the tabs 111, 112 and bolts.

As shown here, the target enclosure 100 may be angled. Particularly, the plates 101, 102, 103, 104 may be angled relative to the front target wall 122 such that the target enclosure 100 tapers toward a rear thereof—thereby, a bullet shot at the front target wall 122 is funneled to the rear of the target enclosure 100. Accordingly, once the user fires into the front target wall 122, it is substantially slowed down by the rubber (or other material) on the front target wall 122 and enters into the target enclosure 100. Once in the target enclosure 100, the angled plates funnel the bullet into the rear of the target enclosure 100 and into the collector tube 105. It should however be appreciated that the target enclosure 100 is not limited to the configuration (i.e., three-dimensional rectangle) shown.

As shown in FIGS. 1-2, the collector tube 105 may be attached at the rear of the target enclosure 100 behind the front target wall 122. As such, once the bullet is funneled into the rear of target enclosure 100, the collector tube 105 may receive the bullet. As shown in FIGS. 1-4, the collector tube 105 may include an elongated tube 205 having a top end and a bottom end and a narrow, elongated opening 206 (FIGS. 3-4) through which the bullet is funneled. For example, the narrow, elongated opening 206 may include (but is not limited to) a width of 2 inches and a height of 14 inches cut vertically into the elongated tube 205.

Figure 3:
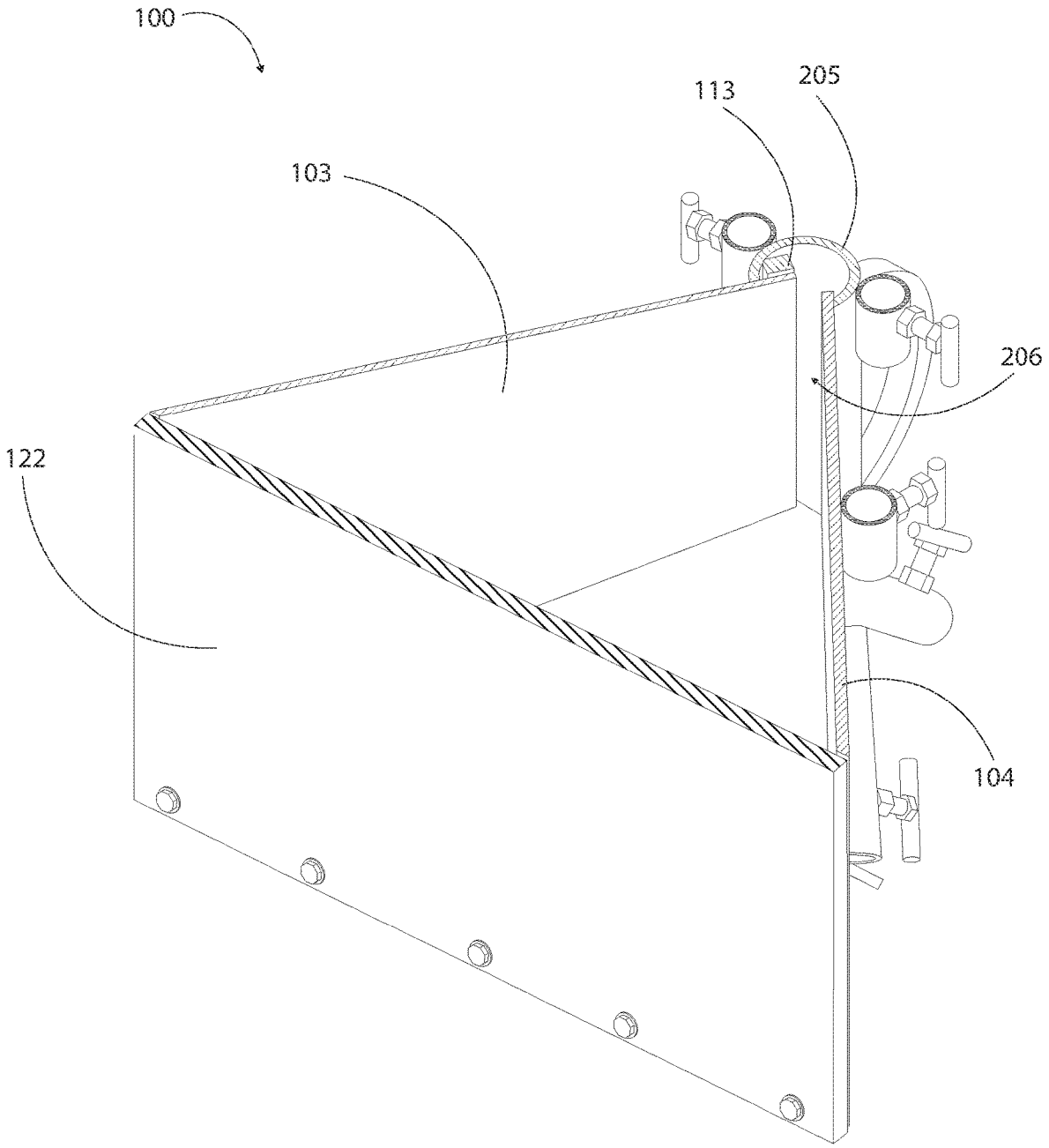
FIG. 3 is a perspective cross-section view of the target enclosure and the bullet catcher, the bullet catching including a bullet stop therein, according to an embodiment of the present disclosure.
Figure 4:
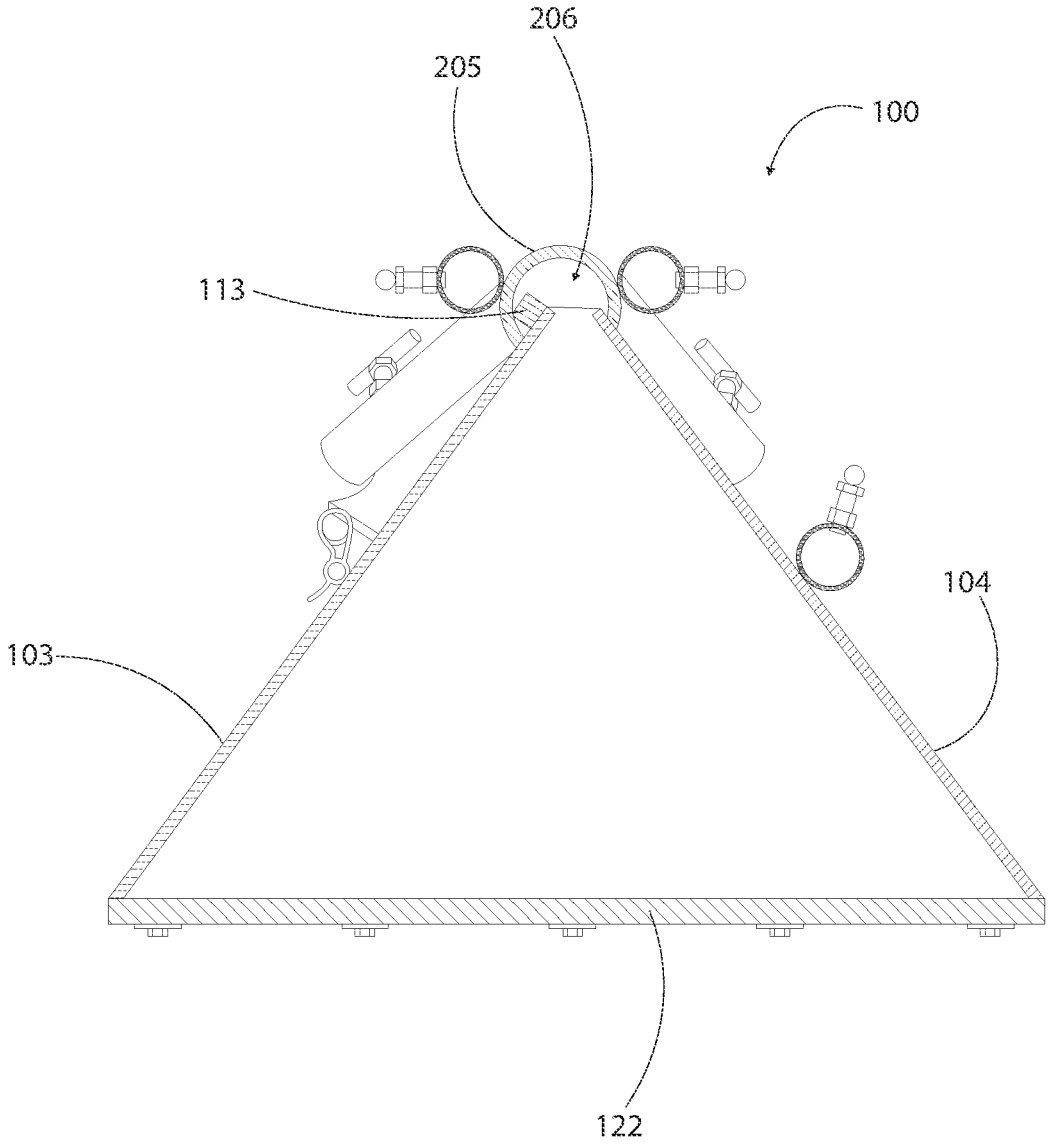
FIG. 4 is a top cross-section view of the target enclosure and the bullet catcher, according to an embodiment of the present disclosure.

As shown in FIGS. 3-4, a bullet stop 113 may be attached behind one of the side plates 103, 104; which may, in some embodiments, include an elongated bar 213. As shown, one of the side plates 103, 104 (i.e., the right side plate 104) are both inset in the elongated tube 205 approximately (but not limited to) 1 inch. The bullet stop 113 may be located therein. Further, in some embodiments, the elongated tube 205 may include layers or strips of strategically placed rubber (e.g., ballistic rubber) (not illustrated) which may be useful for slowing greater bullet velocities from larger calibers, while minimizing weight, cost, and metal hardness required.

Further, the elongated tube 205 may include a top cap 107 and a bottom cap 108 at each end thereof. The bottom cap 108 may be able to be moved; for example, swiveled, pivoted, completely removed, etc. from the elongated tube 205. As shown in FIGS. 1-5, the elongated tube 205 may be generally cylindrical and defining a generally arcuate path of travel for the bullet. Particularly, once the bullet enters the elongated tube 205, the elongated tube 205 meets with the curvature of the elongated tube 205 which utilizes momentum of the bullet to propel itself along the arcuate path. The bullet may then collide with the bullet stop 113, which stops the bullet, absorbs the momentum of the bullet and causes the bullet to fall to the bottom end of the elongated tube 205. The bottom cap 108 at the bottom end of the elongated tube 205 may then be moved (again, swiveled, pivoted, completely removed, etc.) to remove the bullet from the elongated tube 205, enabling the bullet to be recycled.

Particularly, in some embodiments the bottom cap 108 may be held on by a bolt 109 (FIG. 12) welded (or otherwise fixed) inside the elongated tube 205 underneath the elongated bar 213, which protects the bolt 109 from being damaged. The bottom cap 108 may include a hole drilled in it where the bolt 109 can slide through the bottom cap 108. The bottom cap 108 may be held on with a wingnut 110 (FIG. 12) or handle. The bottom cap 108 may then be easily loosened to enable the user to retrieve bullets by untightening or taking off the wingnut 110.

Figure 10:
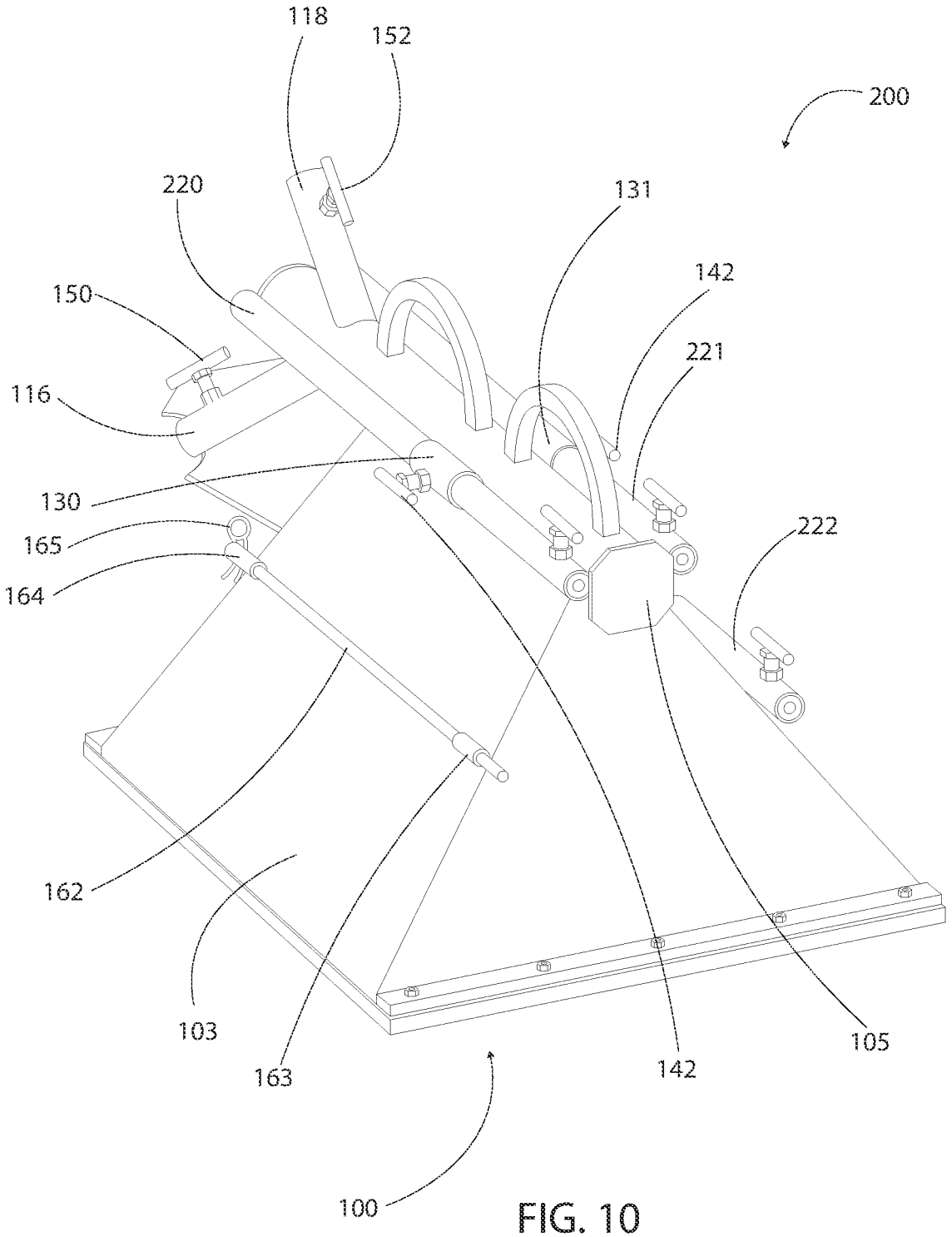
FIG. 10 is a left side perspective view of the bullet catcher target apparatus in a storage position, according to an embodiment of the present disclosure.

Further, in some embodiments, a cleaning rod 162 (FIG. 10) may be included and used to clear out bullets that may be compacted inside the elongated tube 205. The cleaning rod 162 may be secured to the target enclosure 100, as shown in FIG. 10, by sliding it inside two sleeves 163, 164 (FIG. 10) welded (or otherwise fixed) to the left plate 103 of the target enclosure 100. A lower one of the two sleeves 164 may be drilled to allow a hitch pin 165 (FIG. 10) slide through the lower sleeve 164 and a drilled hole on the cleaning rod 162. As shown, the hitch pin 165 may secure the cleaning rod 162 to the target enclosure 100 so that it cannot fall out.

Figure 7A:
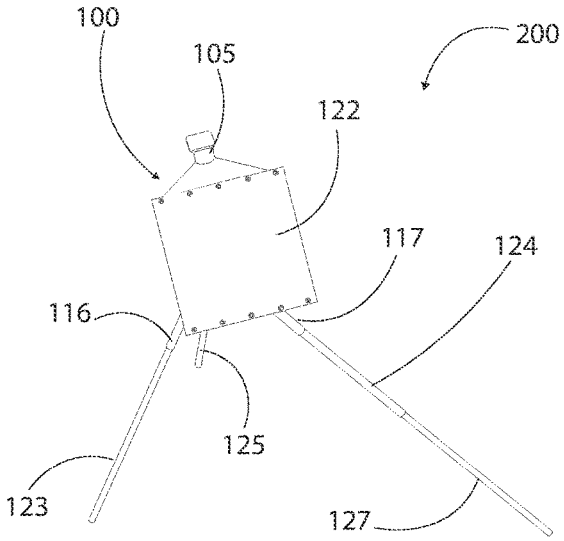
FIG. 7A is a front perspective view of the bullet catcher target apparatus in a left leaning standing position, according to an embodiment of the present disclosure.
Figure 7B:
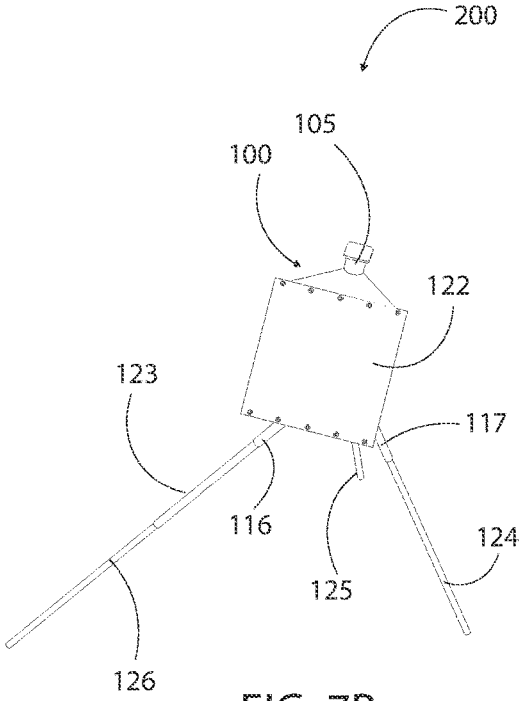
FIG. 7B is a front perspective view of the bullet catcher target apparatus in a right leaning standing position, according to an embodiment of the present disclosure.
Figure 7C:
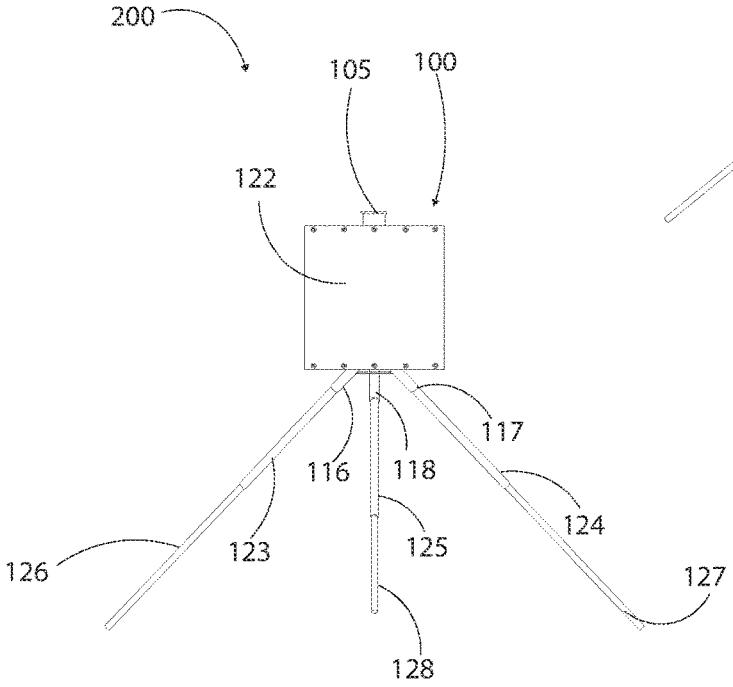
FIG. 7C is a front perspective view of the bullet catcher target apparatus in a level standing position, according to an embodiment of the present disclosure.
Figure 8:
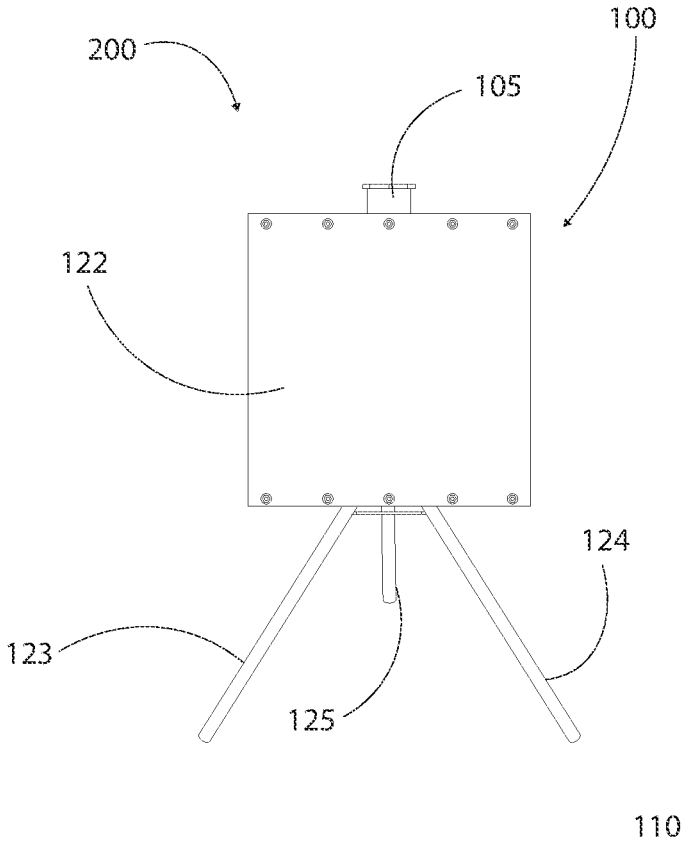
FIG. 8 is a front perspective view of the bullet catcher target apparatus in a kneeling position, according to an embodiment of the present disclosure.
Figure 9:
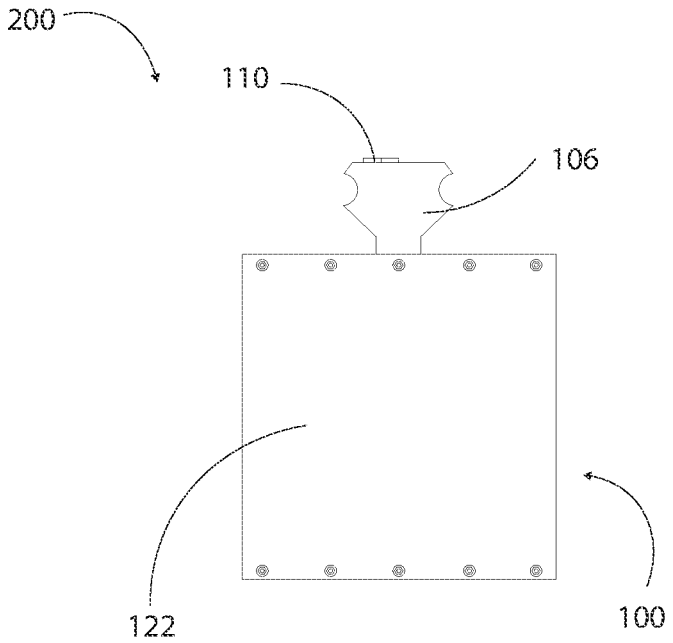
FIG. 9 is a front perspective view of the bullet catcher target apparatus in a prone position, according to an embodiment of the present disclosure.

Referring now to FIGS. 1-9 and specifically FIGS. 5-9, the at least three legs 220, 221, 222 may include a tripod style base. Whilst the three leg configuration is shown and will be described here, it should be appreciated that the bullet catcher target apparatus 200 is not limited to three legs. Further, as shown in FIG. 2 and FIG. 8, in some embodiments a leg deflection shield 106 may be provided underneath the target enclosure 100. The leg deflection shield 106 is fixed at angle such that the leg deflection shield 106 is able deflect missed shots into the ground and not back at the user.

The three legs 220, 221, 222 may be independently height adjustable and movable between a prone position, a kneeling position and a standing position, or a variety of standing positions. As shown, to enable this, the three legs 220, 221, 222 may be telescopic. Particularly, each of the three legs 220, 221, 222 may include an inner leg 126, 127, 128 and an outer leg 123, 124, 125. Further, the bullet catcher target apparatus 200 may include three leg sockets 116, 117, 118 attached toward the bottom end of the collector tube 105 and configured to receive the inner 126, 127, 128 and outer legs 123, 124, 125 therein (and hold the legs 220, 221, 222 in the kneeling position and/or the one or more standing positions).

Figure 5:
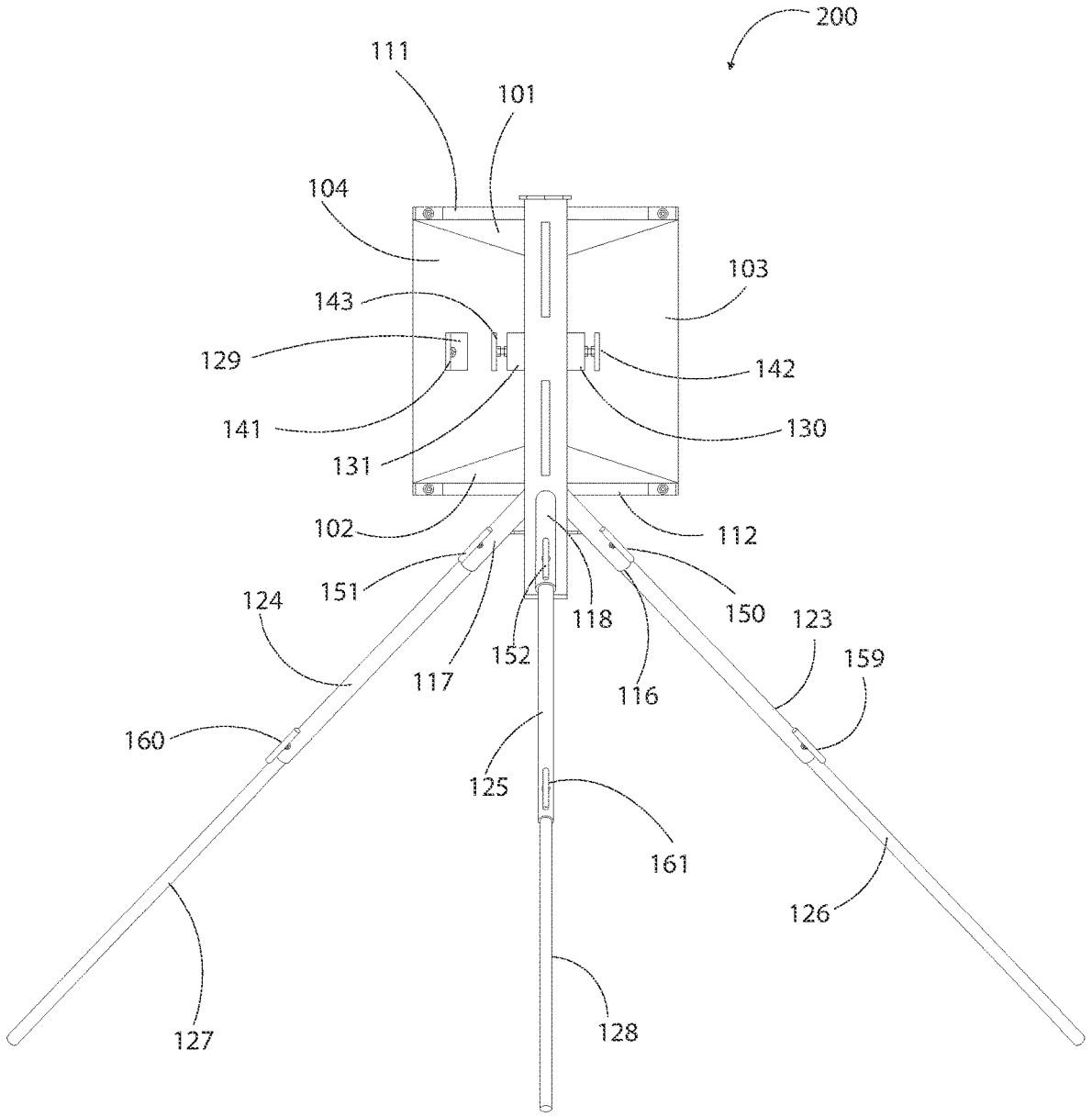
FIG. 5 is a rear view of the bullet catcher target apparatus, according to an embodiment of the disclosure.
Figure 11:
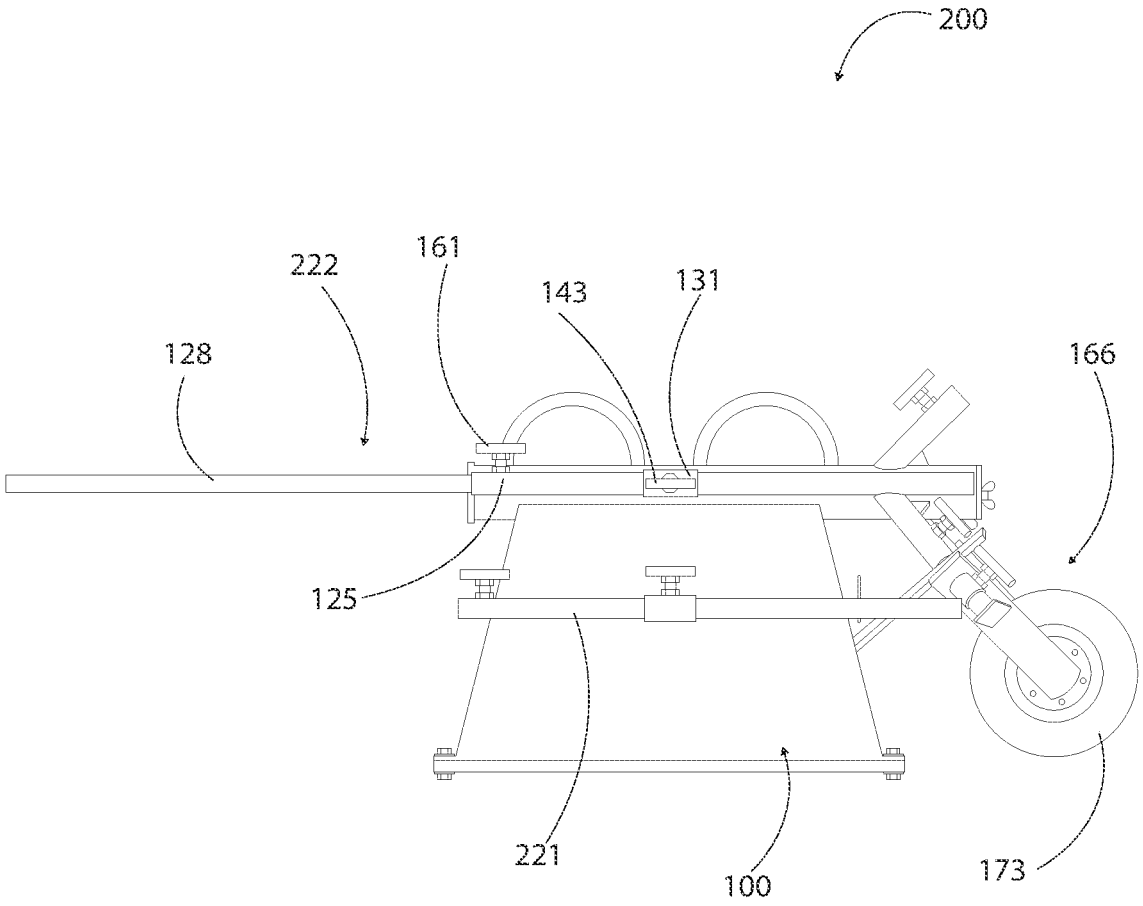
FIG. 11 is a right side view of the bullet catcher target apparatus in a transportation position, according to an embodiment of the present disclosure.
Figure 12:
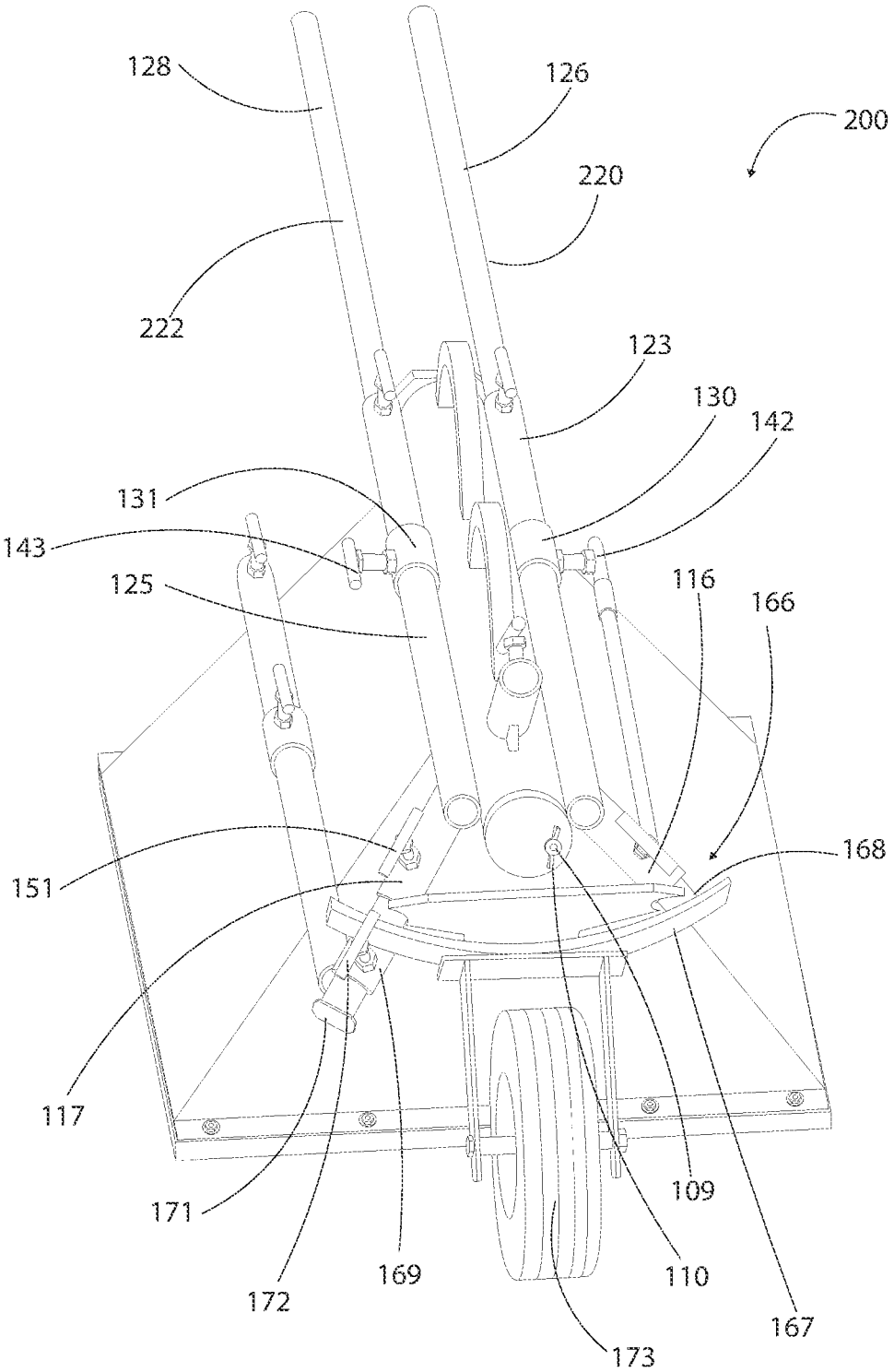
FIG. 12 is a top perspective view of the bullet catcher target apparatus in the transportation position, according to an embodiment of the present disclosure.
Figure 13:
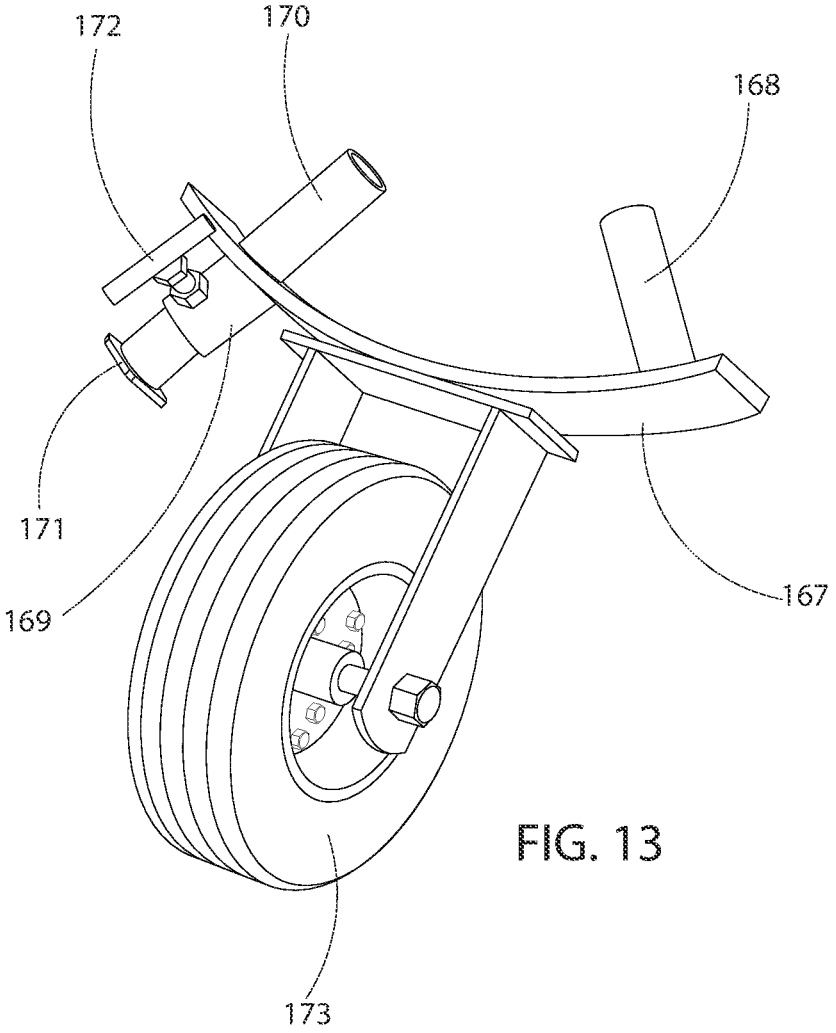
FIG. 13 is a right side perspective view of a transportation wheel assembly, according to an embodiment of the present disclosure.

Further, the three legs 220, 221, 222 may be movable into a storage position (shown in FIG. 10). In this position, the legs 220, 221, 222 may be detachable from the target enclosure 100, or more particularly, the legs 220, 221, 222 may be detachable from the leg sockets 116, 117, 118. As such, the bullet catcher target apparatus 200 may further include at least three storage sockets 129, 130, 131 attached to the collector tube 105 and the target enclosure 100 and configured to receive the legs 220, 221, 222 for holding the legs 220, 221, 222 in the prone position, the storage position (FIG. 10) and/or a transportation position (FIGS. 11-13). Particularly, as shown in FIG. 5, two of the storage sockets 130, 131 may be attached to the collector tube 105 at a mid-point thereof; and one of the storage sockets 129 may be attached to one of the plates (i.e., the left side plate 103).

Figure 6:
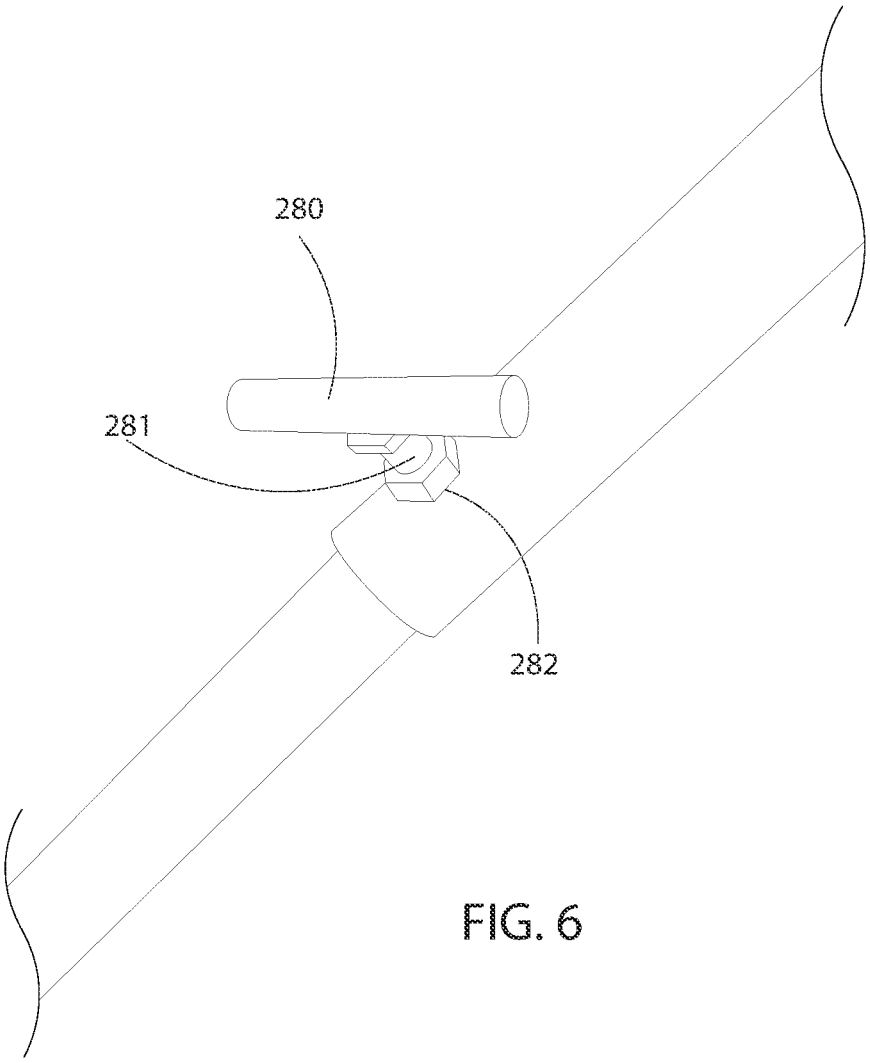
FIG. 6 is a detailed view of a tension handle including a handle rod, a bolt and a nut, according to an embodiment of the disclosure.

Further, tension handles may be provided for keeping the legs 220, 221, 222 tight inside the leg sockets 116, 117, 118 and the storage sockets 129, 130, 131. Particularly, each of the leg sockets 116, 117, 118, each of the storage sockets 129, 130, 131 and each of the outer legs 123, 124, 125 may include a handle rod 280, a bolt 281 and a nut 282, as shown in FIG. 6 particularly. FIG. 6 illustrates one handle rod 280, bolt 281 and nut 282 to demonstrate the contemplated configuration thereof. Each set of handle rod 280, bolt 281 and nut 282 are contemplated to be same or similar and as such have been given the same reference number for the sake of brevity and clarity, however it should be appreciated that each set of handle rod 280, bolt 281 and nut 282 are separate units per socket/outer leg.

The handle rods 280 may be welded (or otherwise fixed) to the bolts 281, creating a handle that can be screwed into and out of the nut 282. The handle rod 280 may be of a sufficient length to provide good torque on the bolt 281, making the legs 220, 221, 222 tight and secure within the leg sockets 116, 117, 118/storage sockets 129, 130, 131 and making the inner legs 126, 127, 128 tight and secure within the outer legs 123, 124, 125. The nut 282 may be welded to the leg sockets 116, 117, 118/storage sockets 129, 130, 131 and outer legs 123, 124, 125. When the legs 220, 221, 222 are inserted into the leg sockets 116, 117, 118 or the storage sockets 129, 130, 131, the handle rod will tighten down creating tension on the legs 220, 221, 222, thereby securing the legs 220, 221, 222 in place.

For example, the tension handle 150 located on a left side leg socket 116 may include a left leg socket nut welded to the left side leg socket 116, and a left side leg bolt welded to the left side leg socket handle rod. The left side leg bolt/leg socket handle rod, once welded, may screw into the left leg socket nut passing through a drilled hole in the left leg socket 116. When the leg 220 is inserted into the left leg socket 116, the left side leg bolt/leg socket handle rod (when welded), will screw and tighten into the leg 220, pinching the leg 220 in place.

When (each of) the inner legs 126, 127, 128 are inserted in (each of) the outer legs 123, 124, 125, the tension handles may be tightened at the desired height to secure the leg in place at the particular height. This ability to independently adjust height of each of the legs 220, 221, 222 may enable the bullet catcher target apparatus 200 to be adjustable to varying terrains. For example, if the bullet catcher target apparatus 200 is placed at a location that has three different depth holes or high humps making the bullet catcher target apparatus 200 unlevel, each of the legs 220, 221, 222 may be adjusted until the bullet catcher target apparatus 200 is brought back to level.

As above and as demonstrated particularly in FIGS. 7A-9, the three legs 220, 221, 222 may movable between a prone position, a kneeling position and a standing position, or a variety of standing positions. Particularly, as shown in FIGS. 7A-7C showing a variety of standing positions, the ability to independently adjust the height of legs 220, 221, 222 may also enable the bullet catcher target apparatus 200 to be placed at different angles, giving unique shooting conditions. More particularly, as shown, this may place the target enclosure 100 at different angles, and thus place the front target wall 122 at different angles. For example, left leaning 'peeking' standing position, as shown in FIG. 7A or a right leaning 'peeking' standing position, as shown in FIG. 7B.

To place the legs 220, 221, 222 in the standing position, the inner leg 126, 127, 128 may be each slid inside the outer leg 123, 124, 125 (once removed from the storage sockets 129, 130, 131). The legs 220, 221, 222 may then be slid into the leg sockets 116, 117, 118 one at a time. For example, the user may slide the left outer leg 123 and left inner leg 126 out of the left storage socket 130, and slide the left outer leg 123 and the left inner leg 126 into the left leg socket 116 until it meets the end of the socket 116. Then, the user may tighten the left leg socket tension handle 150. The user can untighten or tighten the left outer leg tension handle 159, adjusting the inner leg 126 relative to the outer leg 123 to meet a desired (standing) target height. Once the target enclosure 100 is placed, each leg may again, be individually adjusted, to get the target enclosure 100 level and meet most terrain requirements. The user may then shoot into the front target wall 122. Further, each inner leg 126, 127, 128 may be marked at one end to indicate leg extension safety limit.

To place the bullet catcher target apparatus 200 in the kneeling position (as shown in FIG. 8), the target enclosure 100 can either be placed with front target wall 122 face down on the ground, or already in the standing position. Taking the former (the front target wall 122 facing down), the legs 220, 221, 222 may be slid from the storage sockets 129, 130, 131 and into the leg sockets 116, 117, 118 one at a time. Preferably, this may be performed clockwise—particularly from the left leg 220, to the right leg 221 and finally to the rear leg 222. If the bullet catcher target apparatus 200 is already in the standing position, again starting clockwise from the left leg 220 the user may untwist the left outer leg tension handle 159, slowly letting the weight of the target push the left inner leg 126 back into the left outer leg 123, and then retighten the left outer leg tension handle 159. The same can then be done with the right leg 221 and the rear leg 222.

To place the bullet catcher target apparatus 200 in the prone position (FIG. 9), either all of the legs 220, 221, 222 may be left inside the storage sockets 129, 130, 131 (as shown in FIG. 10), or they may be taken out and set aside to avoiding accidental misuses causing damage. The bullet catcher target apparatus 200 may then be pulled back and up using the at least one handle 114, 115 and gripping the elongated tube 205 or one of the three leg sockets 116, 117, 118. The target enclosure 100 may then be pulled back and up to lay on the top cap 107 and top edge of the front target wall 122 and top plate 101.

Referring more specifically now to FIGS. 11-13, as shown, in some embodiments a stationary wheel assembly 166 may be attached to the target enclosure 100 to facilitate transportation of the bullet catcher target apparatus 100. Particularly, the stationary wheel assembly 166 may include one or more transportation wheels 173 that are detachable from the target enclosure 100. To attach the stationary wheel assembly 166 to the target enclosure 100, the stationary wheel assembly 166 may include an insert socket 169 welded to a flat bar 167 allowing for an insertable pipe 170 (attached to the bullet catcher target apparatus 200) to slide through. The insertable pipe 170 may include a flat tab 171 welded (or otherwise fixed) to a bottom thereof to act as a hand guard. The socket 169 may also include a tension handle 172 (similar or same as the tension handles discussed above) for tightening to secure the insertable pipe 170 when carrying around or storing. A welded leg 168 is easy to slide in to find the correct wheel alignment for the insertable pipe 170. The transportation wheel 173 may be removed from the stationary wheel assembly 166 via a bolt and nut.

The stationary wheel assembly 166 may be attached to the bullet catcher target apparatus 200 in either the prone position (FIG. 9) or the storage position (FIG. 10). When attaching the stationary wheel assembly 166 to the bullet catcher target apparatus 200, the side of the welded leg 168 will always be on the right side of the user. First, the user may insert the wheel's welded leg 168 into the left leg socket 116, slide in until finding the proper alignment for the wheel's insert socket 169 to the right leg socket 117. The user may then slide the insertable pipe 170 through the wheel's insert socket 169 then into the right leg socket 117 and fully tighten the right leg socket tension handle 151.

To transport the bullet catcher target apparatus 200, the user may slide the rear outer leg 125 out of the right storage socket 131 toward them, leaving 1 inch exposed from the storage socket 140, then tighten the rear storage socket tension handle 143, securing the leg 222 in place. Next, the user may slide the rear inner leg 128 out of the rear outer leg 125 stopping before the red safety extension marks become visible. The user may then slide the left outer leg 123 down through the left storage socket 130 leaving 1 inch exposed and tighten, securing the outer leg 123 in place. The user may then slide the left inner leg 126 out of the left outer leg 125, stopping before the red safety extensions are visible. Now the bullet catcher target apparatus 200 can be easily transported similar to a wheelbarrow fulcrum, as demonstrated in FIG. 12.

It should be noted that, under appropriate circumstances, considering such issues as design preference, user preferences, marketing preferences, cost, structural requirements, available materials, technological advances, etc., other methods, configurations, materials, etc. are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable relevant patent offices and the public generally, and especially the scientist, engineers and practitioners in the art who are not familiar with patent or legal terms or phraseology, to determine quickly from a cursory inspection the nature and essence of the technical disclosure of the application.

What is claimed is:

1. A bullet catcher target apparatus comprising:

a target enclosure including a front opening opposite a rear, a bottom plate opposite a top plate, and two opposing side plates, the plates being angled such that the target enclosure tapers toward the rear thereof, thereby causing a bullet shot through the target enclosure to be funneled to the rear of the target enclosure;

a front target wall attached to the front of the target enclosure, the front target wall being detachable from the target enclosure and made of self-healing ballistic rubber;

an elongated cylindrical tube attached at the rear of the target enclosure as a collector tube configured to receive the bullet, stop momentum of the bullet and hold the bullet therein, the elongated cylindrical tube having a narrow elongated front opening through which the bullet is funneled, and including a bullet stop located inside the elongated cylindrical tube behind one of the side plates and configured to stop momentum of the bullet as it travels around a curvature of the elongated cylindrical tube, the elongated cylindrical tube further including a top cap and a bottom cap at each end thereof, and wherein the bottom cap is able to be moved, enabling removal of the bullet from the elongated cylindrical tube;

at least three legs attached about the target enclosure, the at least three legs being independently height adjustable and movable between at least a prone position, a kneeling position and one or more standing positions;

at least three leg sockets attached toward a bottom end of the elongated cylindrical tube wherein the at least three legs are each configured for insertion into one of the at least three leg sockets; and wherein the at least three leg sockets are configured to hold the at least three legs in the kneeling position and the one or more standing positions; and at least one handle attached to the target enclosure.

2. The bullet catcher target apparatus of claim 1, wherein the at least three legs are detachable from the target enclosure.

3. The bullet catcher target apparatus of claim 2, further comprising at least three storage sockets;

wherein a portion of the at least three storage sockets are attached about a mid-point of the elongated cylindrical tube and another portion of the at least three storage sockets are attached to one of the plates;

wherein the at least three legs are each configured for insertion into one of the at least three storage sockets; and wherein the at least three storage sockets are configured to hold the at least three legs in the prone position, a storage position and a transportation position.

4. A bullet catcher target apparatus comprising:

a target enclosure including a front opening opposite a rear, a bottom plate opposite a top plate, and two opposing side plates, the plates being angled such that the target enclosure tapers toward the rear thereof, thereby causing a bullet shot through the target enclosure to be funneled to the rear of the target enclosure;

a collector tube attached at the rear of the target enclosure, the collector tube configured to receive the bullet, stop momentum of the bullet and hold the bullet therein; and a cleaning rod removably attached to the target enclosure and configured to aid in removal of compacted bullets from the collector tube.

5. A bullet catcher target apparatus comprising:

a target enclosure including a detachable front target wall, a bottom plate opposite a top plate, and two opposing side plates, the plates being angled relative to the front target wall such that the target enclosure tapers toward a rear thereof, thereby causing a bullet shot through the front target wall to be funneled to the rear of the target enclosure;

an elongated cylindrical tube attached at the rear of the target enclosure behind the front target wall, the elongated cylindrical tube including a top cap, a bottom cap, an opening through which the bullet is funneled, and an elongated bullet stop configured to stop momentum of the bullet as it travels around a curvature of the elongated cylindrical tube, the elongated cylindrical tube configured to hold the bullet therein and the bottom cap being movable to enable removal of the bullet from the elongated cylindrical tube;

at least three telescopic legs removably attached about the target enclosure and including an inner leg and an outer leg, the at least three telescopic legs independently height adjustable and movable between at least a prone position, a kneeling position and one or more standing positions;

a pair of handles attached about the enclosure, the pair of handles facilitating portability of the bullet catcher target apparatus; and at least three leg sockets attached toward a bottom end of the elongated cylindrical tube;

wherein the at least three telescopic legs are each configured for insertion into one of the at least three leg sockets; and wherein the at least three leg sockets are configured to hold the at least three telescopic legs in the kneeling position and the one or more standing positions.

6. The bullet catcher target apparatus of claim 5, further comprising at least three storage sockets;

wherein a portion of the at least three storage sockets are attached about a mid-point of the elongated cylindrical tube and another portion of the at least three storage sockets are attached to one of the plates;

wherein the at least three telescopic legs are each configured for insertion into one of the at least three storage sockets; and wherein the at least three storage sockets are configured to hold the at least three telescopic legs in the prone position, a storage position and a transportation position.

7. A bullet catcher target apparatus comprising:

a target enclosure including a detachable front target wall, a bottom plate opposite a top plate, and two opposing side plates, the plates being angled relative to the front target wall such that the target enclosure tapers toward a rear thereof, thereby causing a bullet shot through the front target wall to be funneled to the rear of the target enclosure;

an elongated cylindrical tube attached at the rear of the target enclosure behind the front target wall, the elongated cylindrical tube including a top cap, a bottom cap, an opening through which the bullet is funneled, and an elongated bullet stop configured to stop momentum of the bullet as it travels around a curvature of the elongated cylindrical tube, the elongated cylindrical tube configured to hold the bullet therein and the bottom cap being movable to enable removal of the bullet from the elongated cylindrical tube;

at least three telescopic legs removably attached about the target enclosure and including an inner leg and an outer leg, the at least three telescopic legs independently height adjustable and movable between at least a prone position, a kneeling position and one or more standing positions;

a pair of handles attached about the enclosure, the pair of handles facilitating portability of the bullet catcher target apparatus; and a cleaning rod removably attached to the target enclosure and configured to aid in removal of compacted bullets from the elongated cylindrical tube.

* * * * *